US005971531A

United States Patent [19]

Dietl et al.

[11] Patent Number: 5,971,531

[45] Date of Patent: Oct. 26, 1999

[54] INK JET CARTRIDGE HAVING REPLACEABLE INK SUPPLY TANKS WITH AN INTERNAL FILTER

[75] Inventors: Steven J. Dietl, Ontario; David P. Breemes, Sr., Palmyra, both of N.Y.

[73] Assignee: Xerox Corporation, Stamford, Conn.

[21] Appl. No.: 08/946,935

[22] Filed: Oct. 8, 1997

[51] Int. Cl.[6] ..... B41J 2/175

[52] U.S. Cl. ..... 347/86

[58] Field of Search ..... 347/85, 86, 87

[56] References Cited

U.S. PATENT DOCUMENTS

| | | | |
|---|---|---|---|
| Re. 32,572 | 1/1988 | Hawkins et al. | 156/626 |
| 4,571,599 | 2/1986 | Rezanka | 347/87 |
| 4,771,295 | 9/1988 | Baker et al. | 347/87 |
| 4,849,774 | 7/1989 | Endo et al. | 347/86 |
| 4,931,811 | 6/1990 | Cowger et al. | 347/87 |
| 5,124,717 | 6/1992 | Campanelli et al. | 347/93 |
| 5,141,596 | 8/1992 | Hawkins et al. | 156/628 |
| 5,185,614 | 2/1993 | Courian et al. | 347/24 |
| 5,204,690 | 4/1993 | Lorenze, Jr. et al. | 347/93 |
| 5,486,855 | 1/1996 | Carlotta et al. | 347/87 |
| 5,491,501 | 2/1996 | Dietl et al. | 347/86 |
| 5,519,425 | 5/1996 | Dietl et al. | 347/87 |
| 5,534,902 | 7/1996 | Hoesly | 347/104 |
| 5,760,805 | 6/1998 | Binnert et al. | 347/86 |
| 5,856,838 | 1/1999 | Oda et al. | 347/85 |

FOREIGN PATENT DOCUMENTS

| | | |
|---|---|---|
| 0 615 846 A1 | 9/1994 | European Pat. Off. . |
| 0 655 336 A1 | 5/1995 | European Pat. Off. . |
| 0 726 155 A2 | 8/1996 | European Pat. Off. . |

OTHER PUBLICATIONS

Patent Abstracts of Japan, Jan. 27, 1995, vol. 095, No. 004.

*Primary Examiner*—N. Le
*Assistant Examiner*—Michael Nghiem
*Attorney, Agent, or Firm*—Robert A. Chittum

[57] ABSTRACT

An ink jet cartridge for use in an ink jet printer has replaceable ink supply tanks. The cartridge includes a housing with an integrally mounted printhead, at least one ink pipe connector protruding from a floor thereof, and internal passageways which interconnect the ink pipe connectors and printhead. The replaceable ink supply tanks, one for each color and each ink pipe connector, contain an ink saturated foam or needled felt member, an ink outlet port, and a filter element which covers the ink outlet port. When the ink supply tank is installed in the cartridge housing, the ink pipe connector extends through the outlet port of the tank and deforms the filter element into compressive contact with the foam or needled felt member. Whenever an ink depleted ink supply tank is replaced with a new ink supply tank, a fresh filter element is available for the cartridge, thus preventing degradation of the cartridge filters during the useful life of the cartridge.

10 Claims, 6 Drawing Sheets

INK JET CARTRIDGE HAVING REPLACEABLE INK SUPPLY TANKS WITH AN INTERNAL FILTER

BACKGROUND OF THE INVENTION

The invention relates to ink jet printing devices and more particularly to ink jet cartridges having replaceable ink tanks with internal filters for use in ink jet printers. The cartridges are mounted on translatable carriages in the ink jet printers for translation thereby during the printing mode.

Existing ink jet printing devices typically rely on some form of filtration, but generally have a filter that is included as part of the printhead mechanism or, in the case of disposable ink jet cartridges which integrate the ink supply tank and printhead, the filter is generally located between the printhead ink inlet and the ink supply tank outlet. In either case, the filter is used without replacement until the printhead or cartridge is removed and discarded. It is well known that ink tanks using foam or felt as an ink holding and dispensing medium contaminate the ink with dislodged fibers and particles. These contaminates delivered from the ink tank range in sizes that can cause the filters used to protect the printhead to become clogged over time during use and can cause immediate or long term ink jet printhead performance degradation. Such contaminants have been known to substantially block the filter and prevent ink droplet ejection from some of the nozzles, which is sometimes referred to as ink jet dropout.

In drop-on-demand, liquid ink printing devices, power pulses are used to selectively eject ink droplets from printhead nozzles to confronting recording mediums, such as paper. Such printing devices may either use piezoelectric, acoustic, or thermal droplet ejectors to expel ink droplets. In the thermal ink jet printing devices, the power pulses are usually produced by resistors located in channels which are selectively addressed with electric pulses to heat rapidly and momentarily vaporize ink in the channels. As voltage is applied across a selected resistor, an ink vapor bubble grows and causes the ink to bulge from channel nozzles. Removal of the voltage from the resistor causes the vapor bubble to collapse quickly and the ink in the channel to retract towards the collapsing bubble, thereby separating the bulging ink and producing a droplet which is propelled from the nozzle towards a recording medium. When the droplet impacts on the recording medium, a dot or spot is deposited. The channel is refilled by capillary action and ink is withdrawn from a supply container or cartridge. The operation of a typical thermal ink jet printer is described, for example, in U.S. Pat. No. 4,849,774.

The carriage type ink jet printer typically has one or more small printheads containing the ink channels and nozzles. The printheads are combined with ink supply tanks to form an ink cartridge. In one type of cartridge, the printhead and one or more ink tanks are an integral part thereof and the entire cartridge is disposable when the ink in the tanks is depleted. In another type of cartridge, such as disclosed, for example, in U.S. patent application Ser. Nos. 08/668,802 filed Jun. 24, 1996, entitled "Ink Supply Container With Improved Foam Retention Properties", and 08/820,624, filed Mar. 19, 1997, entitled "Ink Jet Printer Including A Disengageable Medium Transport For Jam Clearance", the printheads are an integral part thereof with the ink supply tanks for the cartridge being replaceable. Cartridges which have replaceable ink supply tanks may also be replaceable, but are designed for a life expectancy of at least ten ink supply tanks. If the cartridge for replaceable ink supply tanks is a multicolor type, then the replaceable cartridge should not need to be replaced until at least ten ink supply tanks of the same color ink are depleted of ink. The ink supply tanks are mounted on the cartridge and sealingly connected to integral ink connectors of the cartridge which are covered by permanent filters. Both types of cartridges are mounted on a translatable carriage in the printer and translated in one direction to print a swath of information on a recording medium, such as paper. The swath height is equal to the length of the column of nozzles in the printhead. The paper is held stationary during the printing and, after the swath is printed, the paper is stepped a distance equal to the height of the printed swath or a portion thereof. This procedure is repeated until the entire page is printed. The filters for each of these types of cartridges are used for the entire life of the printhead, as contrasted with the present invention where the filters are fresh with each new ink supply tank.

U.S. Pat. No. 4,771,295 discloses an ink supply cartridge construction having multiple ink storage compartments. Ink is stored in a medium of reticulated polyurethane foam of controlled porosity and capillarity. The medium empties into ink pipes, the entrances of which are provided with wire mesh filters for filtering of air bubbles and solid particles from the ink. The ink in the ink pipes is directed to the printheads which are permanently attached to the cartridge. The entire cartridge is replaced when the ink has been depleted therefrom.

U.S. Pat. No. 5,519,425 and U.S. Pat. No. 5,491,501 disclose disposable ink cartridges in which the printheads and ink tanks are integrally attached. The ink is contained in an absorbent material in a housing which is partitioned from the printhead by a housing wall having a vent and an ink outlet in a well which is covered by a filter. The ink flow path is from the absorbent material through the filter into the well and out the ink outlet into a passageway which is in fluid communication with the printhead.

U.S. Pat. No. 5,204,690; U.S. Pat. No. 5,124,717; and U.S. Pat. No. 5,141,596 disclose an ink jet printhead having a filter at the ink inlet of the printhead which is an integral part of the printhead.

As disclosed above and in conventional ink jet cartridges, ink filtration is generally included as a permanent part of the printhead or cartridges having the printheads permanently attached thereto. Thus, the filters must be suitably functional for the life of the printhead. However, the absorbent material used in the typical ink cartridges tends to deteriorate or otherwise give off particles or debris which is collected by the filters, along with all other ink contaminants, so that with use the filters are progressively clogged. This clogging of the filter results in the ink flow to the printhead channels being impeded or blocked, which prevents the cartridge and/or printhead from achieving its normal usage or lifetime.

SUMMARY OF THE INVENTION

It is an object of the present invention to provide an ink jet cartridge having replaceable ink tanks with an integral filter, so that each new ink tank brings with it a fresh filter.

In one aspect of the invention, there is provided an ink jet cartridge having replaceable ink supply tanks for use in a carriage type ink jet printers, comprising: a cartridge housing having a floor with at least one ink pipe connector protruding therefrom, a printhead with an ink inlet and a plurality of nozzles, and an ink flow passageway interconnecting the at least one ink pipe connector with the printhead inlet; at least one replaceable ink supply tank installable in the cartridge housing and containing a compressed foam member therein which is saturated with ink, an outlet port, and a filter element covering said outlet port, the foam member maintaining the ink in said tank at a negative pressure; and wherein the ink pipe connector extends through the outlet port of the ink supply tank when said tank is installed in said cartridge housing, so that the ink pipe connector contacts and deforms the filter element into compressive contact with the foam member, whereby each new ink supply tank provides a fresh filter element for said cartridge.

The present invention will now be described by way of example with reference to the accompanying drawings, wherein like reference numerals refer to like elements, and in which.

DESCRIPTION OF THE PREFERRED EMBODIMENT

Figure 1:
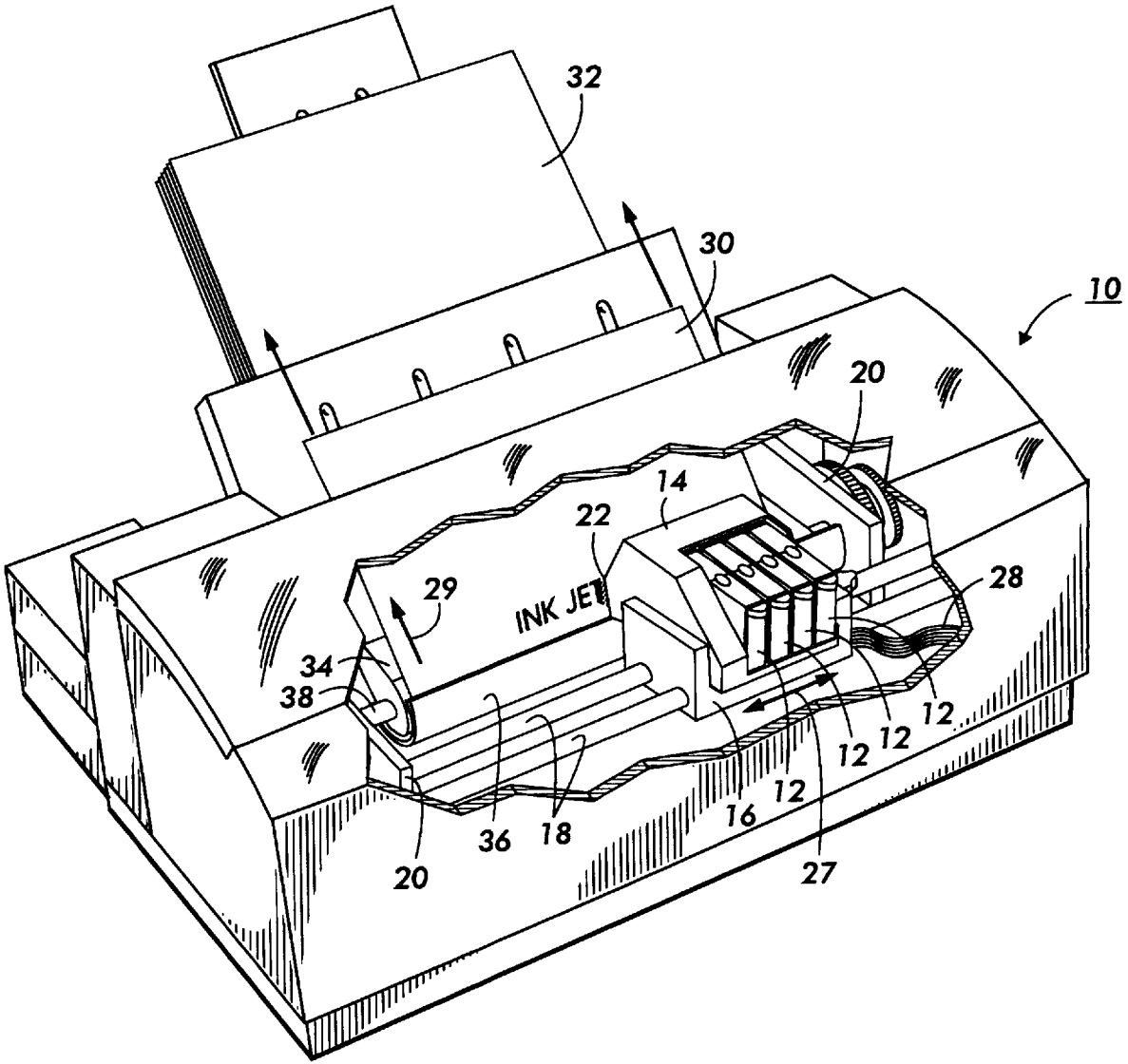
FIG. 1 is an isometric view of a color ink jet printer having the replaceable ink jet supply tanks of the present invention.
Figure 2:
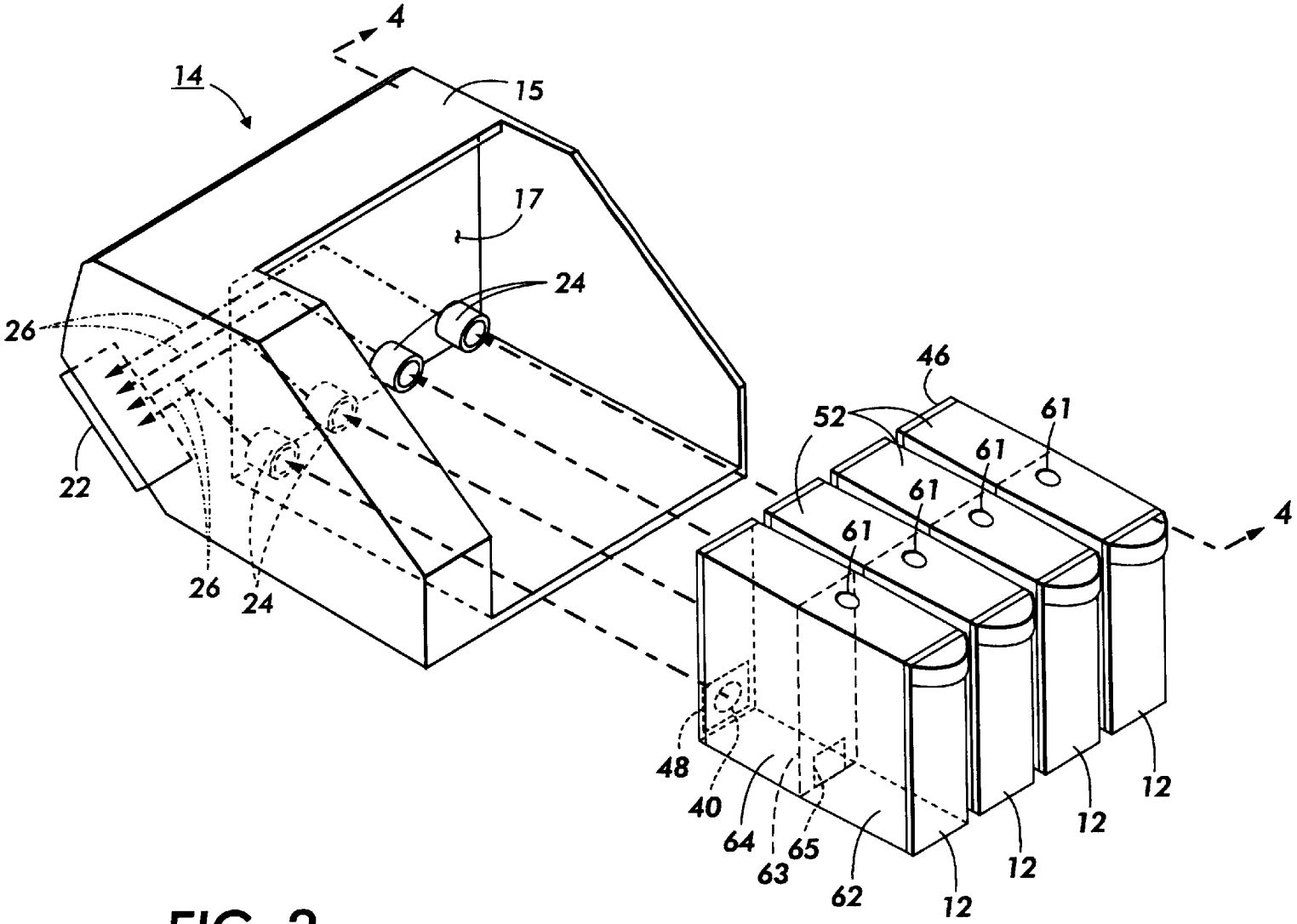
FIG. 2 is a partially exploded isometric view of an ink jet cartridge with integral printhead and ink connectors and replaceable ink tanks of the present invention.

FIG. 1 illustrates an isometric view of a multicolor thermal ink jet printer 10 which incorporates a preferred embodiment of the present invention. The printer includes four replaceable ink supply tanks 12 mounted in a removable ink jet cartridge 14. The ink supply tanks may each have a different color of ink, and in the preferred embodiment, the tanks have yellow, magenta, cyan, and black ink. The removable cartridge is installed on a translatable carriage 16 which is supported by carriage guide rails 18 fixedly mounted in frame 20 of the printer. The removable cartridge is designed to consume or deplete the ink from at least ten ink supply tanks of the same color of ink. The carriage is translated back and forth along the guide rails by any suitable means (not shown), as well known in the printer industry, under the control of the printer controller (not shown). Referring also to FIG. 2, the ink jet cartridge 14 comprises a housing 15 having an integral multicolor ink jet printhead 22 and ink pipe connectors 24 which protrude from a wall 17 of the cartridge for insertion into the ink tanks when the ink tanks are installed in the cartridge housing. Ink flow paths, represented by dashed lines 26, in the cartridge housing interconnects each of the ink connectors with the separate inlets of the printhead. The ink jet cartridge, which comprises the replaceable ink supply tanks that contain ink for supplying ink to the printhead 22, includes an interfacing printed circuit board (not shown) that is connected to the printer controller by ribbon cable 28 through which electric signals are selectively applied to the printhead to selectively eject ink droplets from the printhead nozzles (not shown). The multicolor printhead 22 contains a plurality of ink channels (not shown) which carry ink from each of the ink tanks to respective groups of ink ejecting nozzles of the printhead.

When printing, the carriage 16 reciprocates back and forth along the guide rails 18 in the direction of arrow 27. As the printhead 22 reciprocates back and forth across a recording medium 30, such as single cut sheets of paper which are fed from an input stack 32 of sheets, droplets of ink are expelled from selected ones of the printhead nozzles towards the recording medium 30. The nozzles are typically arranged in a linear array perpendicular to the reciprocating direction of arrow 27. During each pass of the carriage 16, the recording medium 30 is held in a stationary position. At the end of each pass, the recording medium is stepped in the direction of arrow 29. For a more detailed explanation of the printhead and the printing thereby, refer to U.S. Pat. No. 4,571,599 and U.S. Pat. No. Re 32,572, the relevant portions of which are incorporated herein by reference.

A single sheet of recording medium 30 is fed from the input stack 32 through the printer along a path defined by a curved platen 34 and a guide member 36. The sheet is driven along the path by a transport roller 38 as is understood by those skilled in the art or, for instance, as illustrated in U.S. Pat. No. 5,534,902, incorporated herein by reference. As the recording medium exits a slot between the platen 34 and guide member 36, the sheet 30 is caused to reverse bow such that the sheet is supported by the platen 34 at a flat portion thereof for printing by the printhead 22.

With continued reference to FIG. 2, ink from each of the ink supply tanks 12 is drawn by capillary action through the outlet port 40 in the ink supply tanks, the ink pipe connectors 24, and ink flow paths 26 in the cartridge housing to the printhead 22. The ink pipe connectors and flow paths of the cartridge housing supplies ink to the printhead ink channels, replenishing the ink after each ink droplet ejection from the nozzle associated with the printhead ink channel. It is important that the ink at the nozzles be maintained at a slightly negative pressure, so that the ink is prevented from dripping onto the recording medium 30, and ensuring that ink droplets are placed on the recording medium only when a droplet is ejected by an electrical signal applied to the heating element in the ink channel for the selected nozzle. A negative pressure also ensures that the size of the ink droplets ejected from the nozzles remain substantially constant as ink is depleted from the ink supply tanks. The negative pressure is usually in the range of −0.5 to −5.0 inches of water. One known method of supplying ink at a negative pressure is to place within the ink supply tanks an open cell foam or needled felt in which ink is absorbed and suspended by capillary action. Ink tanks which contain ink holding material are disclosed, for example, in U.S. Pat. No. 5,185,614; U.S. Pat. No. 4,771,295; and U.S. Pat. No. 5,486,855.

Figure 6:
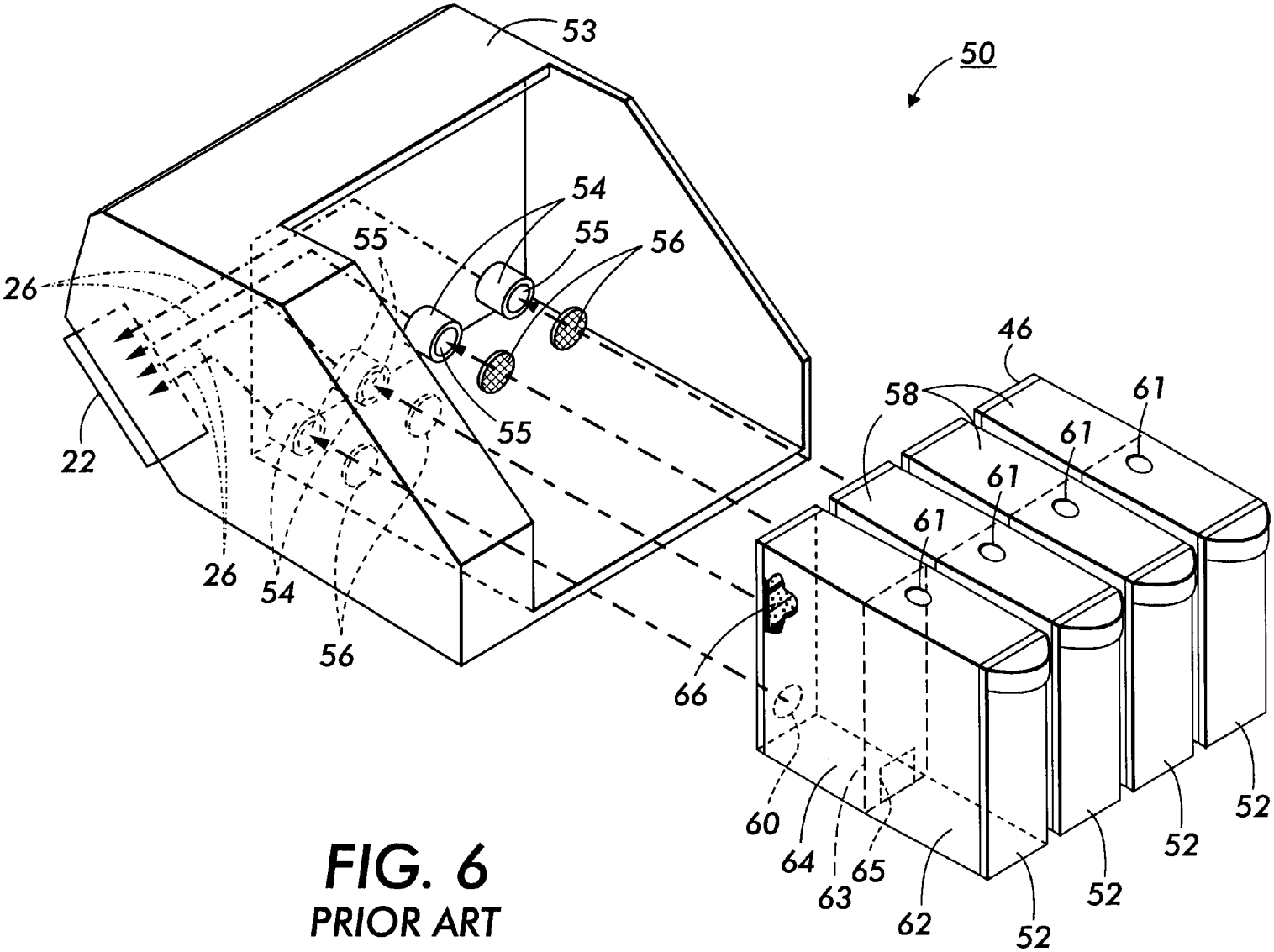
FIG. 6 PRIOR ART
FIG. 6 is a partially exploded isometric view of a prior art ink jet cartridge showing ink pipe connectors with filters.

A typical multicolor ink jet cartridge 50 is shown in partially exploded isometric view in FIG. 6, comprising a cartridge housing 53 having an integrally mounted multicolor printhead 22, ink pipe connectors 54 with wire mesh filters 56 over the connector inlets 55, and ink passageways 26 which interconnect a plurality of groups of ink channels (not shown) of the printhead with the respective one of the ink pipe connectors (one connector for each color of ink), and a plurality of replaceable ink supply tanks 58. Each of the supply tanks having an outlet port 60 shown in dashed line through which the ink pipe connectors extend into compressive contact with the ink saturated foam 66 when the ink supply tanks are installed in the cartridge housing. As disclosed in U.S. patent application Ser. No. 08/668,802 entitled " Ink Supply Container With Improved Foam Retention Properties"filed Jun. 24, 1996 and assigned to the same assignee as the present invention, the ink supply tanks 58 of the typical ink jet cartridge shown in FIG. 6 comprise a housing 52 having two chambers, the upper chamber 62 and the lower chamber 64. The chambers share a common wall 63 with an aperture 65 therein to provide ink flow communication between the two chambers. The lower chamber is filled with an ink holding foam 66 and has the outlet port 60 for accepting the ink pipe connector 54. The upper chamber and foam in the lower chamber is filled with ink through the inlet port 61 in the upper chamber. The filters 56 covering the connector inlets 55 tend to become clogged with contaminants during usage, especially after several ink supply tanks have been depleted of ink through each of the ink pipe connectors 54, much of which contaminants are released by the ink absorbing material, such as, for example, foam 66 in the replaceable ink supply tanks, so that over time the ink flow through the filters are more and more impeded as each new ink supply tank is installed. This is a major problem with the prior art ink jet cartridges, which have permanent filters that must be used as long as the ink jet cartridge is used.

Figure 3:
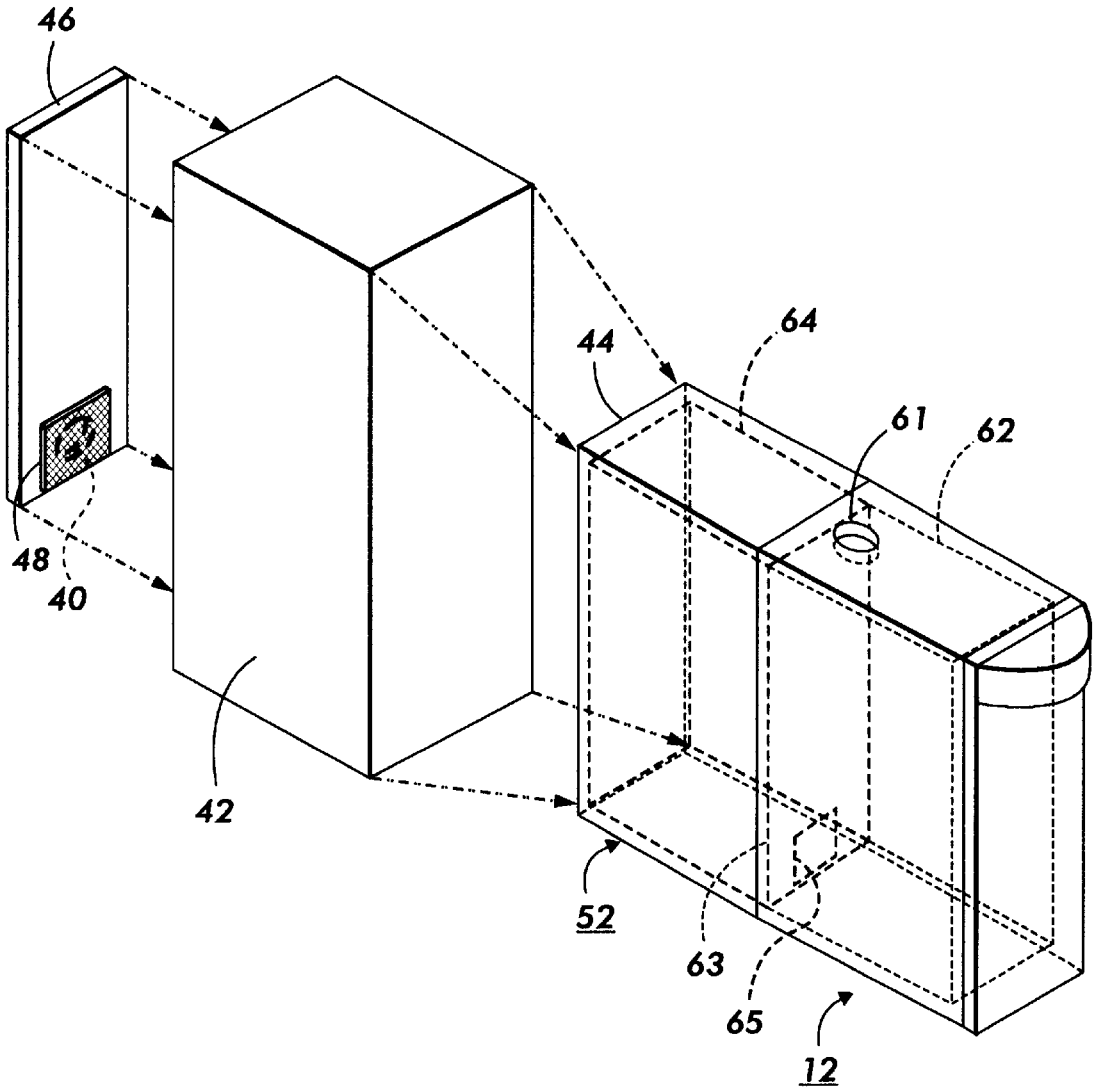
FIG. 3 is an exploded isometric view of the ink tank prior to foam insertion and ink fill.

Similar to the typical ink tank of FIG. 6 and as shown in FIGS. 2 and 3, each ink supply tank 12 of the present invention comprises a housing 52 of any suitable material, such as, for example, polypropylene which contains two compartments separated by a common wall 63. A first compartment 62 has ink stored therein which is introduced therein through inlet 61. A second compartment 64 has an ink absorbing material 42, such as, for example, an open cell foam member or needled felt member inserted therein. An example of an open cell foam is reticulated polyurethane foam. An example of a needled felt member is a needled felt of polyester fibers as disclosed in U.S. Pat. No. 5,519,425 and incorporated herein by reference. Generally, as disclosed in the '425 patent, a scavenger member (not shown) is incorporated adjacent the outlet port 40 when a needled felt of polyester fibers are used which has greater capillarity than the needled felt. Ink from compartment 62 moves through aperture 65 in the common wall 63 to contact the ink absorbing material member 42 and saturate the ink absorbing material member with ink. The ink absorbing material member before insertion into the second compartment 64 has between three and four times the volume of compartment 64, so that the ink absorbing material member which in the preferred embodiment is a foam member, is compressed 25% to 30% of its original size. The second compartment of the ink supply tank 12 has an open end 44 through which the ink absorbing material member 42 is inserted. Cover plate 46 has the same material as the housing 52 and has an outlet port 40, shown in dashed line. In contrast with the prior art cartridges, the filtration in the present invention is not a permanent part of the printhead or cartridge housing, but instead a microfiltration element in the form of a polyester mesh filter 48 which, in one embodiment, is heat staked to weld it on the cover plate side which contacts the foam member. The filter has a filtration rating of 10 $\mu$m to 15 $\mu$m and preferably has a filtration rating of 11 $\mu$m. The cover plate 46 is welded into place following foam member insertion into the second compartment of the ink supply tank. Strength of the heat stake weld is important only during the fabrication process, for the filter is otherwise mechanically locked in place by the wall 17 of the cartridge 14 containing the ink pipe connectors 24 and the force from the compressed ink absorbing material member 42 when the ink supply tank 12 is installed in the cartridge. This yields a robust construction with a fail safe internal retention mechanism that keeps contaminants at their point of origin; viz., in the ink supply tank.

In order to insert the ink absorbing material member 42 into the second compartment 64 of the ink supply tank 12, an assembly fixture (not shown) is used to compress the ink absorbing material member, which may be either a foam member or a needled felt member, with fingers (not shown) to 25% to 30% of its original size and then push the compressed member into the second compartment through its open end 44 until the ink absorbing material member, preferably a foam member, is fully bottomed against the common wall 63. The assembly fixture fingers keep the ink absorbing material member compressed during the insertion process, so that the ink absorbing material member does not physically contact the side walls of the second compartment. This results in no static or dynamic load opposing the insertion motion. A pusher bar (not shown) of the assembly fixture is extended through the fixture fingers to hold the compressed ink absorbing material member in place within the second compartment as the fixture fingers are retracted. Once the ink absorbing material member has been inserted, cover plate 46 is welded in place, ink is introduced through inlet port 61 until the ink absorbing material member is saturated and the first compartment 62 is filled with ink.

Figure 4:
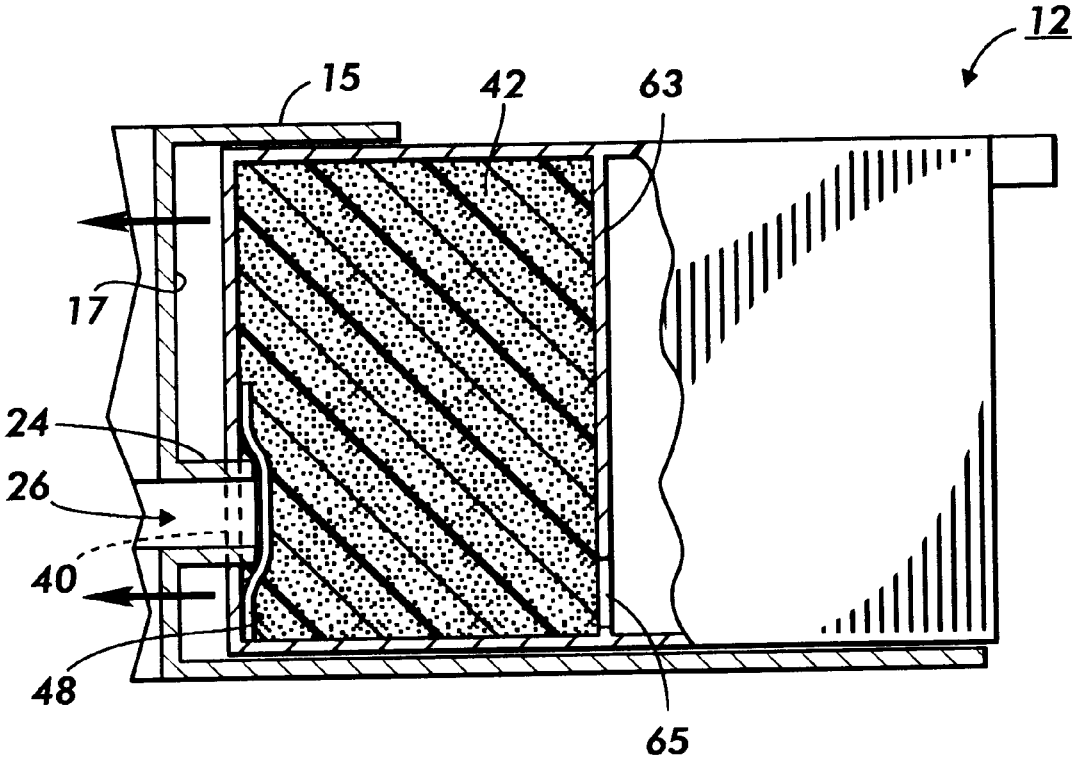
FIG. 4 is a cross sectional, elevation view of the cartridge and ink tank of FIG 2 with the ink tank installed in the cartridge.

In FIG. 4, the ink supply tank 12, shown in cross sectional view, is located in the cartridge 14 on the wall 17 of the cartridge housing 15 and seated over the ink pipe connector 24, so that the connector extends through the outlet port 40 pushing against the filter 48 and causing the filter to bulge against the ink absorbing material member and locally compressing the ink absorbing material member. Once installed, the filter 48 is held taut over the end of the ink pipe connector and in compressive contact with the ink absorbing material member. The capillarity of the filter 48 is higher than that of the compressed ink absorbing material member, so that an ink seal is formed which prevents debris or air bubbles from entering the end of the ink pipe connector and thus to the printhead.

Since the removable cartridge 14 is designed for a lifetime of at least ten ink supply tanks 12 per ink color, it is important that each ink supply tank 12 have a filter 48 of its own in order to avoid the progressive clogging of a permanent filter which is part of the cartridge as provided by existing cartridges, such as shown in FIG. 6.

Figure 5:
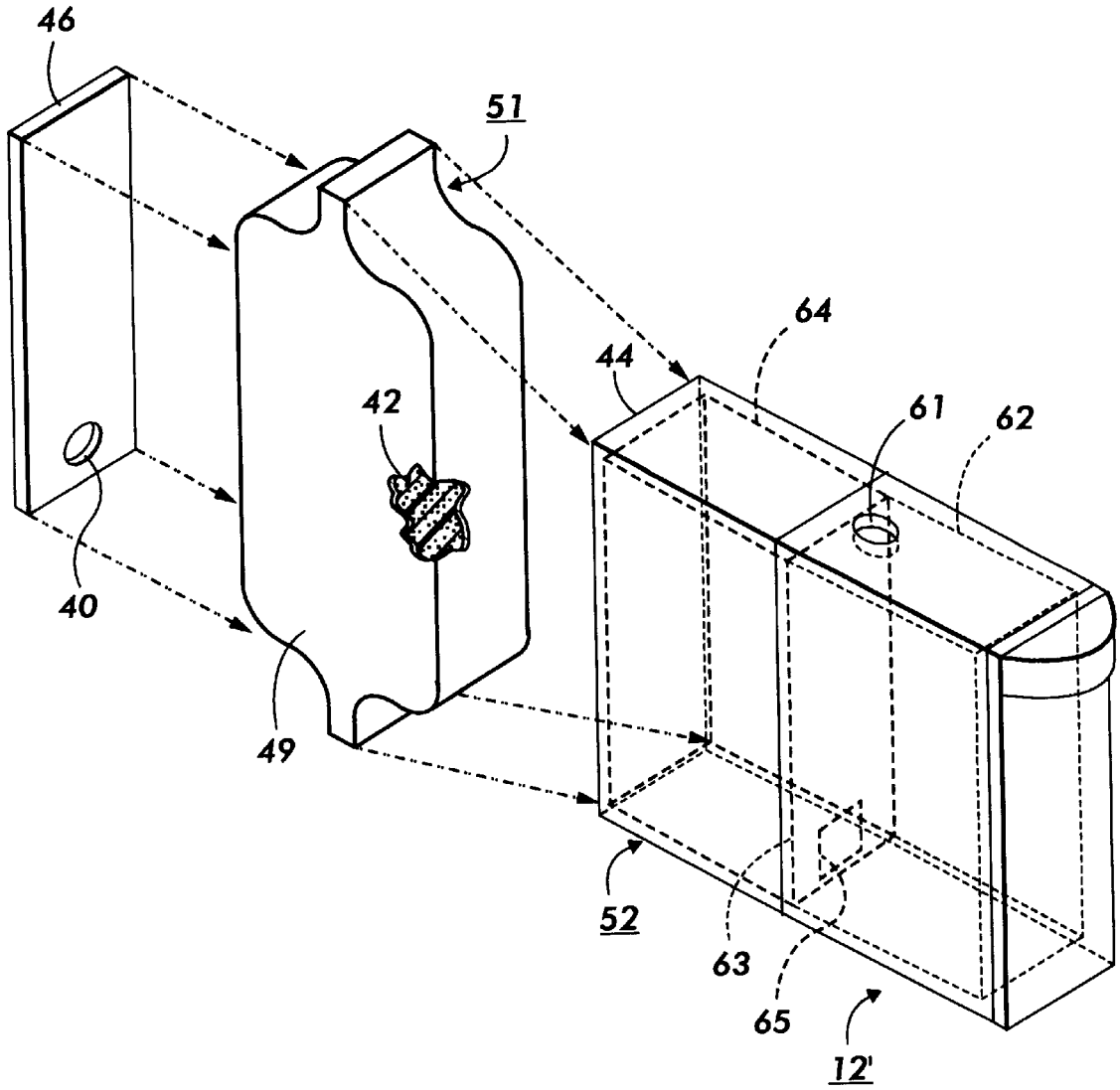
FIG. 5 is an exploded isometric view of an alternate embodiment of the ink tank prior to foam insertion and ink fill.

An alternate embodiment of the present invention is shown in FIG. 5 which is similar to the embodiment shown and described with reference to FIG. 3, except the filter 48 that is heat staked over the outlet port 40 of the cover plate 46 in FIG. 3 is replaced with a filter bag 49 that totally encases the foam member 42. In this alternate embodiment, the ink absorbing material member 42 is compressed and inserted in a bag 49 of filter material and then the bag is sealed. For assembly, the sealed filter bag and encased filter member is inserted into the second compartment of the ink supply tank while it is still compressed in the same manner as described above. As indicated above, the ink absorbing material may be either a foam member, such as a reticulated Polyurethane foam, or a needled felt of polyester fibers. However, the embodiment of FIG. 5 will be described using the foam as the ink absorbing material. To fabricate the bagged foam member 51, the assembly fixture (not shown) must be modified to include a container (not shown) having an internal cavity identical in size with the second compartment 64 of the ink supply tank, so that a casing or bag 49 of polyester mesh filter material is made, for example, having the shape of the second compartment and is placed in the assembly container. The foam member is compressed and inserted into the bag residing in the container by the assembly fixture fingers as described with respect to FIG. 3. The bag of filter material is sealed to form a filter and bag assembly 51 which is inserted in the second compartment of the ink supply tank in the same manner as for FIG. 3, except the filter bag assists in holding the foam member in compression. When the ink supply tank 12' of FIG. 5 is installed in the cartridge 14 (see FIG. 2), the ink pipe connectors 24 extend through the outlet port 40 and locally deforms the filter bag into compressive contact with the foam member, so that the same relationship exists between the ends of the ink pipe connectors and the filter for both FIG. 3 and FIG. 5 embodiments when the ink supply tanks are installed in the cartridge. When a needled felt of polyester fibers is used as the ink absorbing material member 42, a scavenger (not shown) may be optionally used, which is an ink absorbing material having a higher capillarity than the needled felt. The scavenger may be any suitable material, such as, for example, acoustic melamine foam, as described in U.S. Pat. No. 5,519,425 mentioned above. The scavenger is relatively small and arranged so that it resides over the outlet port 40 and is sandwiched between the filter bag 49 and the needled felt.

In another embodiment (not shown) the filter 48 as discussed with reference to FIGS. 2 and 3, is adhered to the ink absorbing material member 42 at a location so that is aligns over the outlet port 40, instead of being heat staked to the cover plate 46. The filter is adhered to the ink absorbing material member by any suitable hot melt porous adhesive.

Although the foregoing description illustrates the preferred embodiment, other variations are possible and all such variations as will be obvious to one skilled in the art are intended to be included within the scope of this invention as defined by the following claims.

We claim:

1. An ink jet cartridge having at least one replaceable ink supply tank for use in a carriage type ink jet printer, comprising:

a cartridge housing having a wall with at least one ink pipe connector protruding therefrom, a printhead with an ink inlet and a plurality of nozzles, and an ink flow passageway interconnecting the at least one ink pipe connector with the printhead inlet;

said at least one replaceable ink supply tank being removably installable in the cartridge housing and having first and second compartments separated by a common wall with an aperture therein, the first compartment having an ink inlet and containing ink, the second compartment having a compressed ink absorbing material member encased in a deformable mesh filter material and an ink outlet port the encased ink absorbing member being saturated with ink from the first compartment via the aperture in said common wall, the encased ink absorbing material member maintaining the ink in said tank at a negative pressure; and wherein the at least one ink pipe connector extends through the ink outlet port of the second compartment of the ink supply tank when said tank is installed in said cartridge housing, so that the ink pipe connector contacts and deforms the mesh filter material which encases the ink absorbent material member into compressive contact with the ink absorbing material member, whereby each new ink supply tank provides a fresh filter material for said cartridge.

2. The ink jet cartridge as claimed in claim 1, wherein the cartridge housing has three additional ink pipe connectors similar to said at least one ink pipe connector for a total of four ink pipe connectors; wherein each ink pipe connector is adapted to receive a replaceable ink supply tank similar to said at least one ink supply tank and be coupled thereto with said each of the ink pipe connectors extending through an outlet port of a respective ink supply tank; and wherein each ink supply tank contains a different color of ink.

3. The ink jet cartridge as claimed in claim 1, wherein the second compartment of the ink supply tank has an open end through which the encased ink absorbing material member is inserted and a cover plate to close the open end of the second compartment; and wherein the cover plate contains the outlet port of the ink supply tank.

4. The ink jet cartridge as claimed in claim 3, wherein the mesh filter material which encases the ink absorbent material member is a polyester mesh filter material; and wherein the filtration rating of the filter material is 10 to 15 $\mu$m.

5. The ink jet cartridge as claimed in claim 4, wherein the ink absorbing material member is an open cell foam.

6. The ink jet cartridge as claimed in claim 4, wherein the ink absorbing material member is a needled felt of polyester fibers.

7. The ink jet cartridge as claimed in claim 4, wherein the mesh filter material which encases the ink absorbing material member is shaped into a bag, so that when the cover plate is closed on the open end of the second compartment, the mesh filter material encasing the ink absorbing material member covers the outlet port in said cover plate.

8. The ink jet cartridge as claimed in claim 7, wherein the ink absorbing material member is an open cell foam having an uncompressed volume of 25% to 30% more than the volume of the second compartment of the ink supply tank.

9. An ink jet cartridge having at least one replaceable ink supply tank for use in a carriage type ink jet printer, comprising:

a cartridge housing having a wall with at least one ink pipe connector protruding therefrom, a printhead with an ink inlet and a plurality of nozzles, and an ink flow passageway interconnecting the at least one ink pipe connector with the printhead inlet;

said at least one replaceable ink supply tank being removably installable in the cartridge housing and having first and second compartments separated by a common wall with an aperture therein, the first compartment having an ink inlet and containing ink, the second compartment having a compressed ink absorbing material member encased in a deformable mesh filter material, the ink absorbent material member being saturated with ink from the first compartment via the aperture in said common wall, said ink absorbent material member maintaining the ink in said ink supply tank at a negative pressure, the second compartment having an open end through which said encased ink absorbent material member is inserted, said ink supply tank having a cover plate to close the open end of the second compartment, and the cover plate having an ink outlet port, so that when the cover plate is closed on the open end of the second compartment of the ink supply tank, the mesh filter material encasing the ink absorbent material member covers the ink outlet port; and wherein the at least one pipe connector extends through the ink outlet port when said ink supply tank is installed in said cartridge housing, so that the ink pipe connector contacts and deforms the mesh filter material which encases the ink absorbent material member into compressive contact with said ink absorbing material member, whereby each new ink supply tank provides a fresh filter material for the ink jet cartridge.

10. The ink jet cartridge as claimed in claim 9, wherein the ink absorbing material member is an open cell foam having an uncompressed volume of 25% to 30% more than the volume of second compartment of the ink supply tank; and where in the filtration rating of the encasing mesh filter material is 10 to 15 $\mu$m.

* * * * *